US011299856B2

(12) United States Patent
Sachs et al.

(10) Patent No.: US 11,299,856 B2
(45) **Date of Patent: *Apr. 12, 2022**

(54) SINGLE PLY TISSUE HAVING IMPROVED CROSS-MACHINE DIRECTION PROPERTIES

(71) Applicant: Kimberly-Clark Worldwide, Inc., Neenah, WI (US)

(72) Inventors: Mark W. Sachs, Appleton, WI (US); Lynda E. Collins, Neenah, WI (US); Kevin J. Vogt, Neenah, WI (US); Richard A. Zanon, Appleton, WI (US); Christopher L. Satori, Hortonville, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/007,365

(22) Filed: Aug. 31, 2020

(65) Prior Publication Data

US 2022/0064862 A1 Mar. 3, 2022

(51) Int. Cl.
*D21H 27/00* (2006.01)
*D21F 5/18* (2006.01)
*D21F 7/12* (2006.01)

(52) U.S. Cl.
CPC ..... *D21H 27/005* (2013.01); *D21F 5/18* (2013.01); *D21F 7/12* (2013.01)

(58) Field of Classification Search
CPC .. D21H 27/005; D21H 27/002; D21H 27/004; D21F 7/12; D21F 5/18; B32B 2555/00; B32B 2307/718; A47K 10/22
See application file for complete search history.

(56) References Cited

U.S. PATENT DOCUMENTS 4,440,597 A 4/1984 Wells et al.
4,638,907 A 1/1987 Bedenk et al.
5,591,309 A 1/1997 Rugowski et al.
5,607,551 A 3/1997 Farrington et al.
5,656,132 A 8/1997 Farrington et al.
5,672,248 A 9/1997 Wendt et al.
5,746,887 A 5/1998 Wendt et al.
5,772,845 A 6/1998 Farrington et al.
5,830,321 A 11/1998 Lindsay et al.
6,017,417 A 1/2000 Wendt et al.
6,585,856 B2 7/2003 Zwick et al.
6,827,818 B2 12/2004 Farrington, Jr. et al.
6,887,348 B2 5/2005 Hermans et al.
6,893,535 B2 5/2005 Hermans et al.
7,166,189 B2 1/2007 Burazin et al.
7,294,229 B2 11/2007 Hada et al.
7,399,378 B2 7/2008 Edwards et al.
7,497,925 B2 3/2009 Hermans et al.
7,611,605 B2 11/2009 Burazin et al.
7,726,349 B2 6/2010 Mullally et al.
7,828,932 B2 11/2010 Hermans et al.
7,935,220 B2 5/2011 Edwards et al.
7,935,221 B2 * 5/2011 Allen ..... D21F 11/14 162/116
7,935,409 B2 5/2011 Burazin et al.
7,938,932 B2 5/2011 Hermans et al.
7,972,474 B2 * 7/2011 Underhill ..... D21F 11/145 162/111
8,481,133 B2 7/2013 Hermans et al.
8,574,399 B2 11/2013 Hermans et al.
8,652,597 B2 2/2014 Hermans et al.
8,852,398 B2 10/2014 Hermans et al.
8,940,376 B2 1/2015 Stage et al.
8,956,503 B2 2/2015 Hermans et al.
9,222,224 B2 12/2015 Shannon
10,161,084 B2 12/2018 Burazin et al.
2003/0136529 A1 7/2003 Burazin et al.
2004/0118544 A1 6/2004 Tirimacco et al.
2004/0200590 A1 10/2004 Wilhelm
2005/0133175 A1 6/2005 Hada et al.
2005/0145352 A1 7/2005 Hermans et al.

(Continued)

FOREIGN PATENT DOCUMENTS

EP 0625610 B1 11/1999
WO 0008253 A1 2/2000

(Continued)

OTHER PUBLICATIONS

Tissue360.tappi, "Sheet Structure Process Effect on Tissue Properties", https://tissue360.tappi.org/.

(Continued)

*Primary Examiner* — Jose A Fortuna

(74) *Attorney, Agent, or Firm* — Kimberly-Clark Worldwide, Inc.

(57) ABSTRACT

Provided are tissue webs, and products produced therefrom, that are generally durable, flexible and have improved cross-machine direction (CD) properties, such as CD tensile energy absorption (CD TEA), CD stretch and CD modulus. The inventive tissue products generally comprise a single tissue ply that has been prepared by through-air drying and more preferably by through-air drying without creping. Moreover, the products may be produced using a transfer fabric positioned between the forming fabric and the through-air drying fabric where the transfer fabric imparts the nascent web with a high degree of CD strain.

17 Claims, 4 Drawing Sheets

(56) References Cited

U.S. PATENT DOCUMENTS

| | | | | |
|---|---|---|---|---|
| 2005/0145353 | A1 | 7/2005 | Troxell et al. | |
| 2005/0148257 | A1 | 7/2005 | Hermans et al. | |
| 2005/0161179 | A1 | 7/2005 | Hermans et al. | |
| 2005/0236122 | A1 | 10/2005 | Mullally et al. | |
| 2005/0241786 | A1 | 11/2005 | Edwards et al. | |
| 2006/0086472 | A1 | 4/2006 | Hermans et al. | |
| 2006/0130986 | A1 | 6/2006 | Flugge-Berendes et al. | |
| 2007/0000629 | A1 | 1/2007 | Tirimacco et al. | |
| 2007/0137807 | A1 | 6/2007 | Schulz et al. | |
| 2008/0073047 | A1 | 3/2008 | Bakken et al. | |
| 2009/0065160 | A1 | 3/2009 | Hermans et al. | |
| 2009/0194244 | A1 | 8/2009 | Harper et al. | |
| 2010/0051217 | A1* | 3/2010 | Allen | D21G 1/00 162/116 |
| 2011/0155337 | A1 | 6/2011 | Murray et al. | |
| 2012/0247698 | A1 | 10/2012 | Murray et al. | |
| 2013/0160960 | A1 | 6/2013 | Hermans et al. | |
| 2014/0118544 | A1 | 5/2014 | Asaka et al. | |
| 2014/0209264 | A1* | 7/2014 | Tirimacco | D21H 17/52 162/164.3 |
| 2017/0049280 | A1* | 2/2017 | Weaver | A47K 10/22 |
| 2018/0135248 | A1 | 5/2018 | Collins et al. | |
| 2018/0142421 | A1* | 5/2018 | Rouse | D21G 1/00 |
| 2018/0195239 | A1 | 7/2018 | Ziegenbein | |
| 2018/0334778 | A1* | 11/2018 | Shannon | D21H 13/24 |
| 2019/0127919 | A1* | 5/2019 | Burazin | D21H 27/32 |
| 2019/0264395 | A1* | 8/2019 | Rouse | D21F 11/14 |
| 2020/0173114 | A1* | 6/2020 | Vogt | D21H 27/005 |
| 2020/0270812 | A1* | 8/2020 | Holz | B32B 5/02 |
| 2021/0140119 | A1* | 5/2021 | Vogt | D21H 27/02 |
| 2021/0207327 | A1* | 7/2021 | Margo Moreno | D21H 21/146 |
| 2021/0321831 | A1* | 10/2021 | Vogt | B32B 5/06 |
| 2022/0010496 | A1* | 1/2022 | Tirimacco | A61K 8/0208 |

FOREIGN PATENT DOCUMENTS

| | | | |
|---|---|---|---|
| WO | 07078562 | A2 | 7/2007 |
| WO | 10023616 | A2 | 3/2010 |
| WO | 13041989 | A2 | 3/2013 |

OTHER PUBLICATIONS

Co-Pending U.S. Appl. No. 17/007,375, filed Aug. 31, 2020, by Sachs et al. for "Single Ply Tissue Having Improved Cross-Machine Direction Properties."

Co-Pending U.S. Appl. No. 17/007,394, filed Aug. 31, 2020, by Sachs et al. for "Multi-Ply Tissue Products Having Improved Cross-Machine Direction Properties."

* cited by examiner

SINGLE PLY TISSUE HAVING IMPROVED CROSS-MACHINE DIRECTION PROPERTIES

BACKGROUND

Generally, papermakers, particularly manufacturers of low basis weight tissue products, have attempted to improve product softness and durability by altering certain machine and cross-machine direction properties such as tensile strength, stretch and modulus. Of particular interest are cross-machine direction (CD) properties, such as CD tensile energy absorption (CD TEA), CD stretch and CD modulus, because tissue products are typically weakest in the cross-machine direction and most in-use failures occur in this direction. For example, U.S. Pat. No. 7,972,474 to Underhill sought to improve CD properties by manufacturing tissue products using a through-air drying process in which the transfer fabric and the through-air drying fabric were both textured fabrics having a substantially uniform high strain distribution in the cross-machine direction. The resulting tissue products, while having improved cross-machine direction properties such as low modulus and relatively high stretch, were relatively weak in the cross-machine direction, such as CD tensile strengths less than about 600 g/3".

In other instances, tissue makers have altered manufacturing processes to produce products having low degrees of CD modulus. While a low modulus may reduce the perception of the tissue as being stiff, at some point a low CD modulus may be interpreted as indicative of a weak or "flimsy" tissue. This is particularly true when low CD modulus is accompanied by a relatively low CD tensile strength, such as less than about 600 g/3". Thus, in certain instances tissue makers have attempted to increase CD modulus at a given tensile strength. For example, U.S. Pat. No. 7,300,543 to Mullally utilized papermaking fabrics with deep discontinuous pockets in an uncreped through-air dried tissue process to produce tissue products having the desired CD slope values. Similarly, U.S. Pat. No. 8,500,955 to Hermans attempted to improve CD slope at a given CD tensile strength by rewetting the dried tissue web, pressing the rewetted web and then drying the web for a second time.

While tissue makers have been able to modulate certain cross-machine properties they have not succeeded in balancing all of the properties to produce a tissue product that has sufficient strength to withstand use but is also soft and pliable. Therefore, there remains a need in the art for tissue webs and products having balanced cross-machine direction properties and methods of manufacturing the same.

SUMMARY

The present invention provides tissue webs, and products produced therefrom, that are generally durable, flexible and have improved cross-machine direction (CD) properties, such as CD tensile energy absorption (CD TEA), CD stretch and CD modulus. The inventive products generally comprise a single ply tissue web that has been prepared by through-air drying and more preferably by through-air drying without creping. In this manner, in a particularly preferred embodiment, the invention provides novel uncreped through-air dried (UCTAD) tissue webs.

In particularly preferred embodiments the tissue webs of the present invention are manufactured by transferring a partially dewatered web to a transfer fabric, particularly a highly structured transfer fabric, that molds the partially dewatered web prior to it being transferred to a through-air drying fabric. Surprisingly, molding imparted by the transfer fabric is retained in the dried web and resulting tissue products, which improves several important physical properties such as CD TEA, CD stretch and CD modulus. For example, in one embodiment, tissue products produced according to the present invention may have a CD stretch of about 14.0 percent or greater, such as about 14.5 percent or greater, such as about 15.0 percent or greater, such as from about 14.0 to about 17.0 percent.

Accordingly, in one embodiment, the invention provides a single ply tissue product having a CD stretch of about 14.0 percent or greater, such as about 14.5 percent or greater, such as about 15.0 percent or greater, such as from about 14.0 to about 17.0 percent, such as about 14.5 to about 16.5 percent. Surprisingly, the foregoing CD Stretch values may be achieved without creping the tissue web. Rather than crepe the web during manufacture, the instant tissue products may be produced by transferring a partially dewatered web to a transfer fabric having a high degree of topography to strain the nascent sheet in the cross-machine direction.

In other embodiments the present invention provides a through-air dried single ply tissue product having a CD tensile strength of about 550 g/3" or greater, more preferably about 575 g/3" or greater and still more preferably about 600 g/3" or greater, and a CD stretch from about 14.0 to about 17.0 percent.

In another embodiment tissue products of the present invention have sufficient strength to maintain integrity in-use but are flexible and soft. For example, the products may have a geometric mean tensile strength (GMT) from about 700 to about 1,000 g/3" and a Stiffness Index less than about 5.0. In particularly preferred embodiments the products may have relatively low CD modulus, such as a CD Slope of about 3.5 kg or less, such as from about 2.0 to about 3.5 kg.

In still other embodiments the inventive tissue products are able to absorb a large amount of energy in the cross-machine direction before rupturing. For example, the inventive tissue products may have a high degree of CD Stretch, such as from about 14.0 to about 17.0 percent and a CD TEA of about 6.0 g·cm/cm$^2$ or greater, such as about 6.5 g·cm/cm$^2$ or greater, such as about 7.0 g·cm/cm$^2$ or greater, such as from about 6.0 to about 8.0 g·cm/cm$^2$ and a Stiffness Index less than about 5.0.

In still other embodiments the present invention provides a method of manufacturing a single ply tissue product having improved cross-machine direction properties comprising the steps of dispersing papermaking fibers in water to form an aqueous suspension of fibers; depositing the aqueous suspension of fibers on a forming fabric to form a wet tissue web; partially dewatering the wet tissue web; transferring the partially dewatered tissue web to a transfer fabric having a CD strain from about to about 19 percent; transferring the molded tissue web to a through-air drying fabric and conveying the tissue web over a dryer while supported by the through-air drying fabric to dry the tissue web to a consistency of at least about 95 percent.

DEFINITIONS

Figure 1:
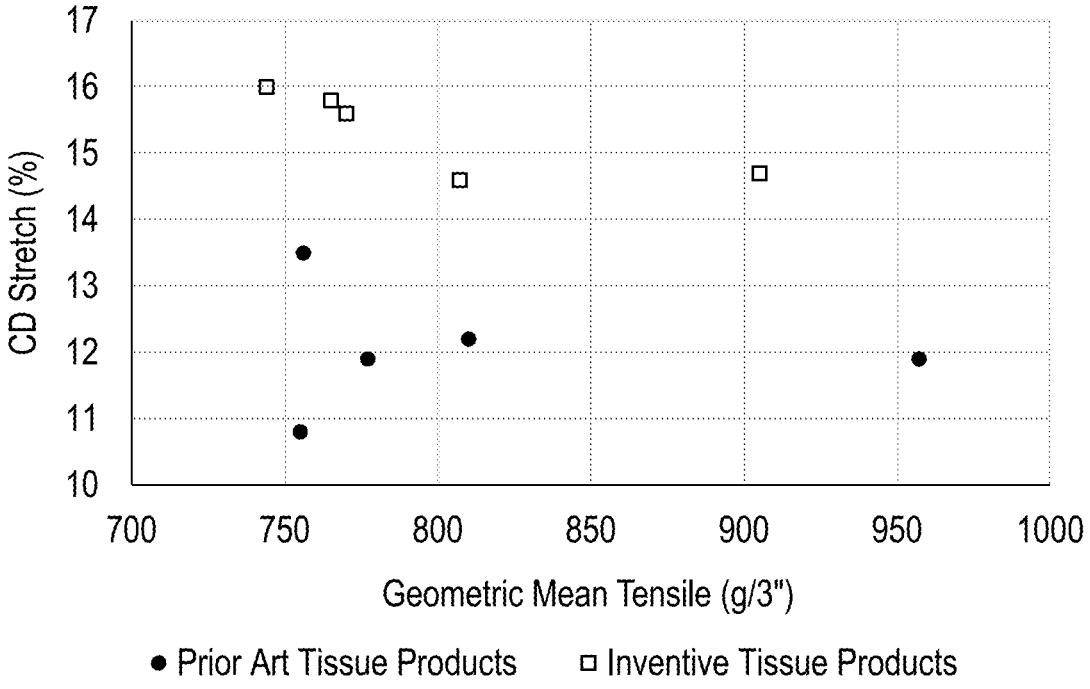
FIG. 1 is a graph of geometric mean tensile (x-axis) versus CD Stretch (y-axis) for inventive (□) and prior art (•) tissue products.

As used herein the term "Basesheet" refers to a tissue web formed by any one of the papermaking processes described herein that has not been subjected to further processing, such as embossing, calendering, treatment with a binder or softening composition, perforating, plying, folding, or rolling into individual rolled products.

As used herein the term "Tissue Product" refers to products made from basesheets and includes, bath tissues, facial tissues, paper towels, industrial wipers, foodservice wipers, napkins, medical pads, and other similar products.

As used herein the term "Ply" refers to a discrete tissue web used to form a tissue product. Individual plies may be arranged in juxtaposition to each other. In a preferred embodiment, tissue products prepared according to the present invention comprise a single ply.

As used herein, the term "Layer" refers to a plurality of strata of fibers, chemical treatments, or the like, within a ply. A "Layered Tissue Web" generally refers to a tissue web formed from two or more layers of aqueous papermaking furnish. In certain instances, the aqueous papermaking furnish forming two or more of the layers comprises different fiber types.

As used herein the term "Basis Weight" generally refers to the conditioned weight per unit area of a tissue and is generally expressed as grams per square meter (gsm). Basis weight is measured as described in the Test Methods section below. While the basis weights of tissue products prepared according to the present invention may vary, in certain embodiments the products have a basis weight of about 30 gsm or greater, such as about 34 gsm or greater, such as about 36 gsm or greater, such as from about 30 to about 42 gsm, such as from about 32 to about 40 gsm, such as from about 34 to about 38 gsm.

As used herein, the term "Caliper" refers to the thickness of a tissue product, web, sheet or ply, typically having units of microns (μm) and is measured as described in the Test Methods section below.

As used herein, the term "Sheet Bulk" refers to the quotient of the caliper (μm) divided by the basis weight (gsm) and having units of cubic centimeters per gram (cc/g). Tissue products prepared according to the present invention may, in certain embodiments, have a sheet bulk of about 10 cc/g or greater, such as from about 12 to about 20 cc/g, such as from about 14 to about 20 cc/g.

As used herein, the term "Slope" refers to the slope of the line resulting from plotting tensile versus stretch and is an output of the MTS TestWorks™ in the course of determining the tensile strength as described in the Test Methods section herein. Slope typically has units of kilograms (kg) and is measured as the gradient of the least-squares line fitted to the load-corrected strain points falling between a specimen-generated force of 70 to 157 grams (0.687 to 1.540 N).

As used herein, the term "Geometric Mean Slope" (GM Slope) generally refers to the square root of the product of machine direction slope and cross-machine direction slope. While the GM Slope may vary amongst tissue products prepared according to the present invention, in certain embodiments, tissue products may have a GM Slope less than about 5.00 kg, such as less than about 4.75 kg, such as less than about 4.50, such as from about 3.00 to about 5.00 kg.

As used herein, the term "Geometric Mean Tensile" (GMT) refers to the square root of the product of the machine direction tensile strength and the cross-machine direction tensile strength of the web. The GMT of tissue products prepared according to the present invention may vary, however, in certain instances the GMT may be about 600 g/3" or greater, such as about 700 g/3" or greater, such as about 800 g/3" or greater, such as from about 600 to about 1,000 g/3".

As used herein, the term "Stiffness Index" refers to the quotient of the geometric mean tensile slope, defined as the square root of the product of the MD and CD slopes (having units of kg), divided by the geometric mean tensile strength (having units of grams per three inches).

$$\text{Stiffness Index} = \frac{\sqrt{MD\ \text{Tensile Slope (kg)} \times CD\ \text{Tensile Slope (kg)}}}{GMT\ (\text{g/3''})} \times 1{,}000$$

While the Stiffness Index of tissue products prepared according to the present invention may vary, in certain instances the Stiffness Index may be about 5.0 or less, such as about 4.5 or less, such as about 4.0 or less, such as from about 3.5 to about 5.0.

As used herein, the term "TEA Index" refers to the geometric mean tensile energy absorption (having units of $g \cdot cm/cm^2$) at a given geometric mean tensile strength (having units of grams per three inches) as defined by the equation:

$$TEA\ \text{Index} = \frac{GM\ \ TEA\ (\text{g} \cdot \text{cm/cm}^2)}{GMT\ (\text{g/3''})} \times 1{,}000$$

While the TEA Index may vary, in certain instances tissue products prepared according to the present invention have a TEA Index of about 10.0 or greater, such as about 11.0 or greater, such as about 12.0, or greater, such as from about 10.0 to about 13.0, such as from about 11.0 to about 13.0.

DETAILED DESCRIPTION

In general, the present disclosure is directed to tissue webs, and products produced therefrom, having improved cross-machine direction (CD) properties. In particularly preferred embodiments the tissue webs are converted into single ply tissue products and more particularly rolled tissue products comprising a single ply tissue web spirally wound about a core. The single ply webs and products are generally durable, flexible and have improved CD properties, such as improved CD tensile energy absorption (CD TEA), CD stretch and CD modulus, measured as CD Slope.

For example, in certain embodiments, the invention provides single ply tissue products having a CD stretch of about 14.0 percent or greater, such as about 14.5 percent or greater, such as about 15.0 percent or greater, such as from about 14.0 to about 17.0 percent, such as about 14.5 to about 16.5 percent. Surprisingly, the foregoing levels of CD stretch are achieved despite the tissue products being uncreped and having relatively high degrees of CD tensile strength, such as about 550 g/3" or greater, more preferably about 575 g/3" or greater and still more preferably about 600 g/3" or greater, such as from about 550 to about 700 g/3", such as from about 575 to about 650 g/3".

In other embodiments the tissue products of the present invention have good durability in the cross-machine direction, such as a CD TEA of about 6.0 g·cm/cm$^2$ or greater, such as about 6.5 g·cm/cm$^2$ or greater, such as about 7.0 g·cm/cm$^2$ or greater, such as from about 6.0 to about 8.0 g·cm/cm$^2$. The foregoing CD TEA values may be achieved at CD tensile strengths of about 550 g/3" or greater, more preferably about 575 g/3" or greater and still more preferably about 600 g/3" or greater, such as from about 550 to about 700 g/3", such as from about 575 to about 650 g/3". In this manner, the inventive tissue products may have a CD TEA Index of about 10.0 or greater, such as about 10.5 or greater, such as about 11.0 or greater, such as from about 10.0 to about 12.0.

Figure 2:
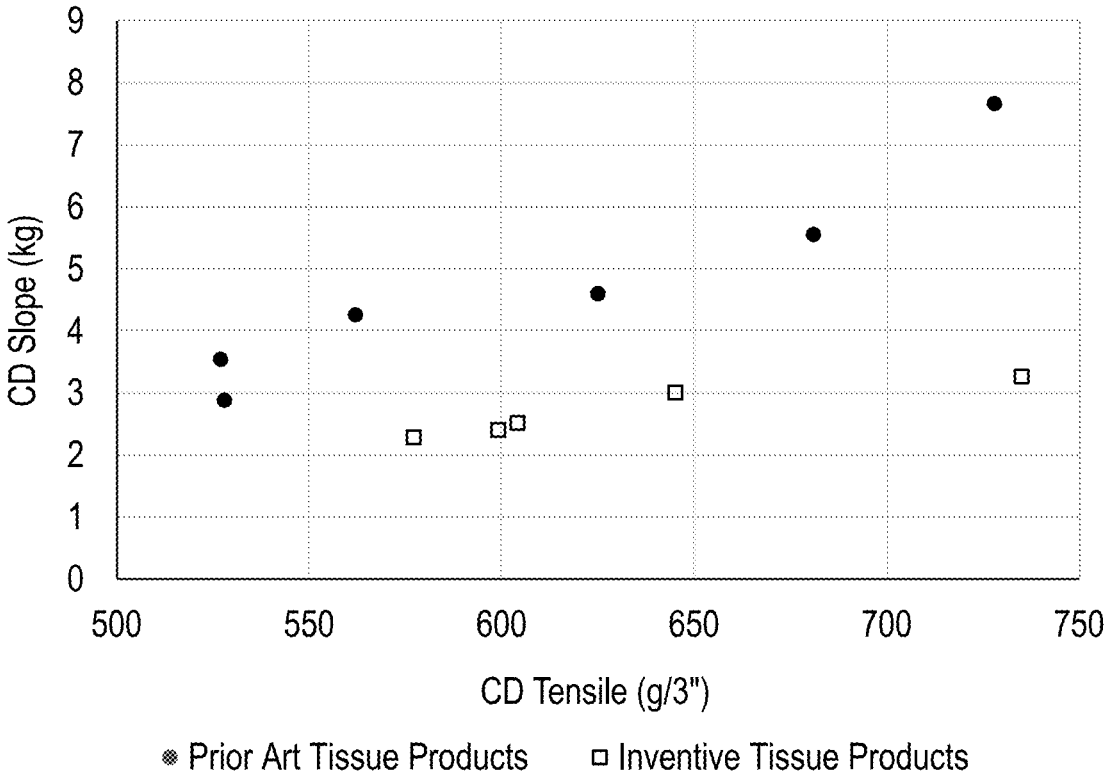
FIG. 2 is a graph of CD tensile (x-axis) versus CD Slope (y-axis) for inventive (□) and prior art (•) tissue products.

A comparison of the CD properties of several inventive and commercially available tissue products may be found in Table 1, below. Compared to commercially available tissue products, the inventive tissue products have a high degree of CD stretch, low CD slope and a relatively high degree of CD tensile strength. These differences are further illustrated in FIGS. 1 and 2.

TABLE 1

| Description | Year Purchased | Plies | TAD | Creped | GMT (g/3") | CD Tensile (g/3") | CD TEA (g · cm/cm$^2$) | CD Slope (g/3") | CD Stretch (%) |
|---|---|---|---|---|---|---|---|---|---|
| Cottonelle Clean Care | 2017 | 1 | Y | N | 1122 | 625 | 5.49 | 4.60 | 9.88 |
| Cottonelle Gentle Care | 2017 | 1 | Y | N | 755 | 562 | 5.26 | 4.26 | 10.8 |
| Charmin Essentials Soft | 2017 | 1 | Y | Y | 777 | 681 | 9.71 | 5.55 | 11.9 |
| Charmin Essentials Strong | 2017 | 1 | Y | Y | 957 | 728 | 9.78 | 7.66 | 11.9 |
| Scott Tube Free | 2017 | 1 | Y | N | 810 | 527 | 6.04 | 3.54 | 12.2 |
| Scott Extra Soft | 2017 | 1 | Y | N | 756 | 528 | 6.31 | 2.88 | 13.5 |
| Inventive | — | 1 | Y | N | 905 | 735 | 7.55 | 3.27 | 14.7 |
| Inventive | — | 1 | Y | N | 807 | 645 | 6.86 | 3.01 | 14.6 |
| Inventive | — | 1 | Y | N | 765 | 604 | 6.57 | 2.52 | 15.8 |
| Inventive | — | 1 | Y | N | 770 | 599 | 6.56 | 2.41 | 15.6 |
| Inventive | — | 1 | Y | N | 744 | 577 | 6.47 | 2.29 | 16.0 |

Accordingly, in certain embodiments, the inventive tissue products are both durable and flexible, particularly in the cross-machine direction. For example, single ply tissue products prepared according to the present invention have geometric mean tensile strength (GMT) of about 600 g/3" or greater, such as about 700 g/3" or greater, such as about 800 g/3" or greater, such as from about 600 to about 1,000 g/3" and Stiffness Index of about 5.0 or less, such as about 4.5 or less, such as about 4.0 or less, such as from about 3.5 to about 5.0.

In certain embodiments the products of the present invention may comprise a single ply through-air dried tissue web having CD tensile strengths of about 550 g/3" or greater, more preferably about 575 g/3" or greater and still more preferably about 600 g/3" or greater, such as from about 550 to about 700 g/3", such as from about 575 to about 650 g/3", and a CD Slope of about 3.0 kg or less, such as from about 2.0 to about 3.0 kg.

The relatively low degrees of stiffness do not come at the expense of cross-machine direction durability. For example, the tissue products generally have CD tensile strengths of about 550 g/3" or greater, more preferably about 575 g/3" or greater, and still more preferably about 600 g/3" or greater, such as from about 550 to about 700 g/3", such as from about 575 to about 650 g/3", and a CD TEA of about 6.0 g·cm/cm$^2$ or greater, such as about 6.5 g·cm/cm$^2$ or greater, such as about 7.0 g·cm/cm$^2$ or greater, such as from about 6.0 to about 8.0 g·cm/cm$^2$. Further, the products are highly extensible prior to failure, particularly in the cross-machine direction, such that the products generally have a CD Stretch of about 14.0 percent or greater, such as about 14.5 percent or greater, such as about 15.0 percent or greater, such as from about 14.0 to about 17.0 percent, such as about 14.5 to about 16.5 percent.

Surprisingly, the improved cross-machine direction properties may be achieved without creping the tissue web. Rather than crepe the web during manufacture, the instant tissue products may be produced by transferring a partially dewatered web to a transfer fabric having a high degree of topography to strain the nascent sheet in the cross-machine direction. In this manner, tissue products of the present invention may be manufactured by a process that employs a transfer fabric, particularly a transfer fabric that transfers the nascent tissue web from a forming fabric to a through-air drying fabric. Such fabrics may be employed in through-air drying (TAD) manufacturing processes. In particularly preferred embodiments tissue products are manufactured using a high topography transfer fabric and through-air drying fabric in an uncreped through-air dried (UCTAD) process.

Figure 3:
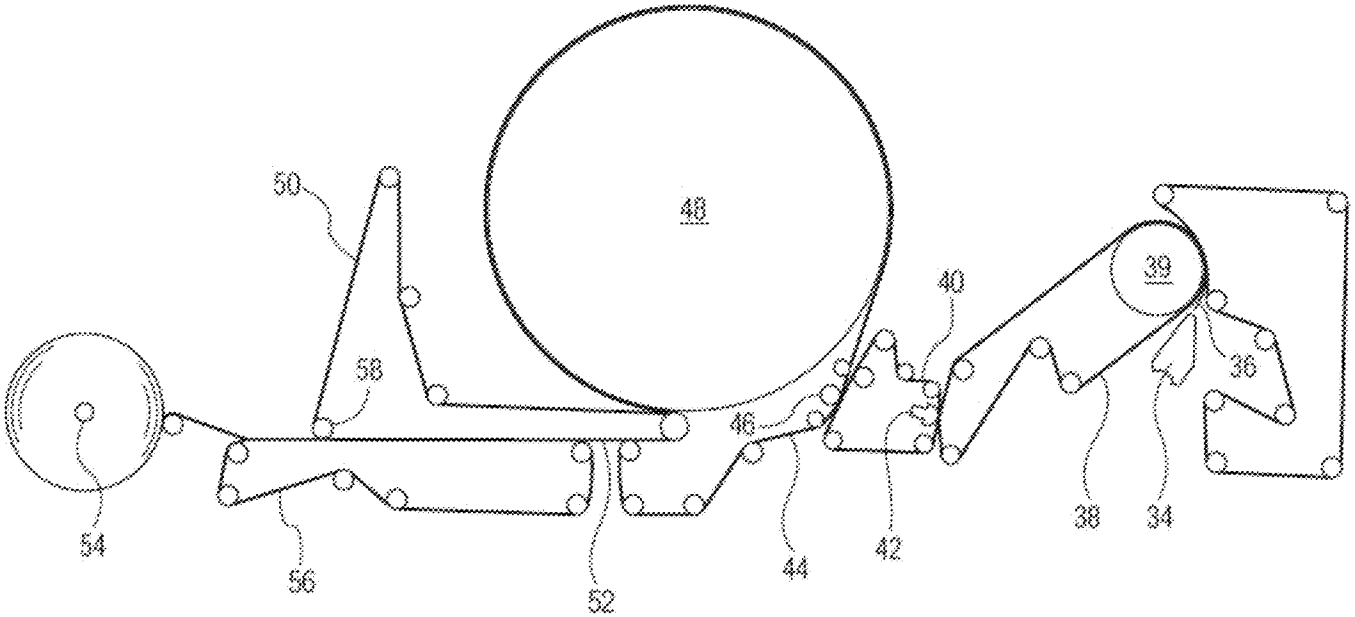
FIG. 3 illustrates one embodiment for forming a basesheet useful in the production of a tissue product according to the present invention.

With reference now to FIG. 3, a method for making through-air dried paper sheets is illustrated. Shown is a twin wire former having a papermaking headbox 34, such as a layered headbox, which injects or deposits a stream 36 of an aqueous suspension of papermaking fibers onto the forming fabric 38 positioned on a forming roll 39. The forming fabric serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 40. In one embodiment, the transfer fabric can be traveling at a slower speed than the forming fabric in order to impart increased stretch into the web. This is commonly referred to as a "rush" transfer. The relative speed difference between the two fabrics can be from 0 to 60 percent, more specifically from about 15 to 45 percent. Transfer is preferably carried out with the assistance of a vacuum shoe 42 such that the forming fabric and the transfer fabric simultaneously converge and diverge at the leading edge of the vacuum slot.

The transfer fabric preferably has a relatively high degree of surface topography, particularly a high degree of substantially machine direction oriented topography. In certain preferred embodiments the transfer fabric may be a woven fabric and may comprise surface topography imparted by weaving the fabric such that the web contacting surface of the fabric has a plurality of continuous, substantially parallel, ridges separated from one another by valleys. The ridges may be oriented substantially in the machine-direction and may be straight or have a wave-like shape. In those instances where the ridges have a wave-like shape, they may be skewed slightly, such as from about 1 to about 2 degrees, relative to the machine direction. Further, the wave-like ridges may have a wavelength from about 4 to about 8 mm, such as from about 5 to about 6 mm. The upper surfaces of the ridges is preferably substantially smooth, while the valleys are smooth with small, uniform pores to facilitate draining of water from the nascent web and through the fabric.

Figure 4:
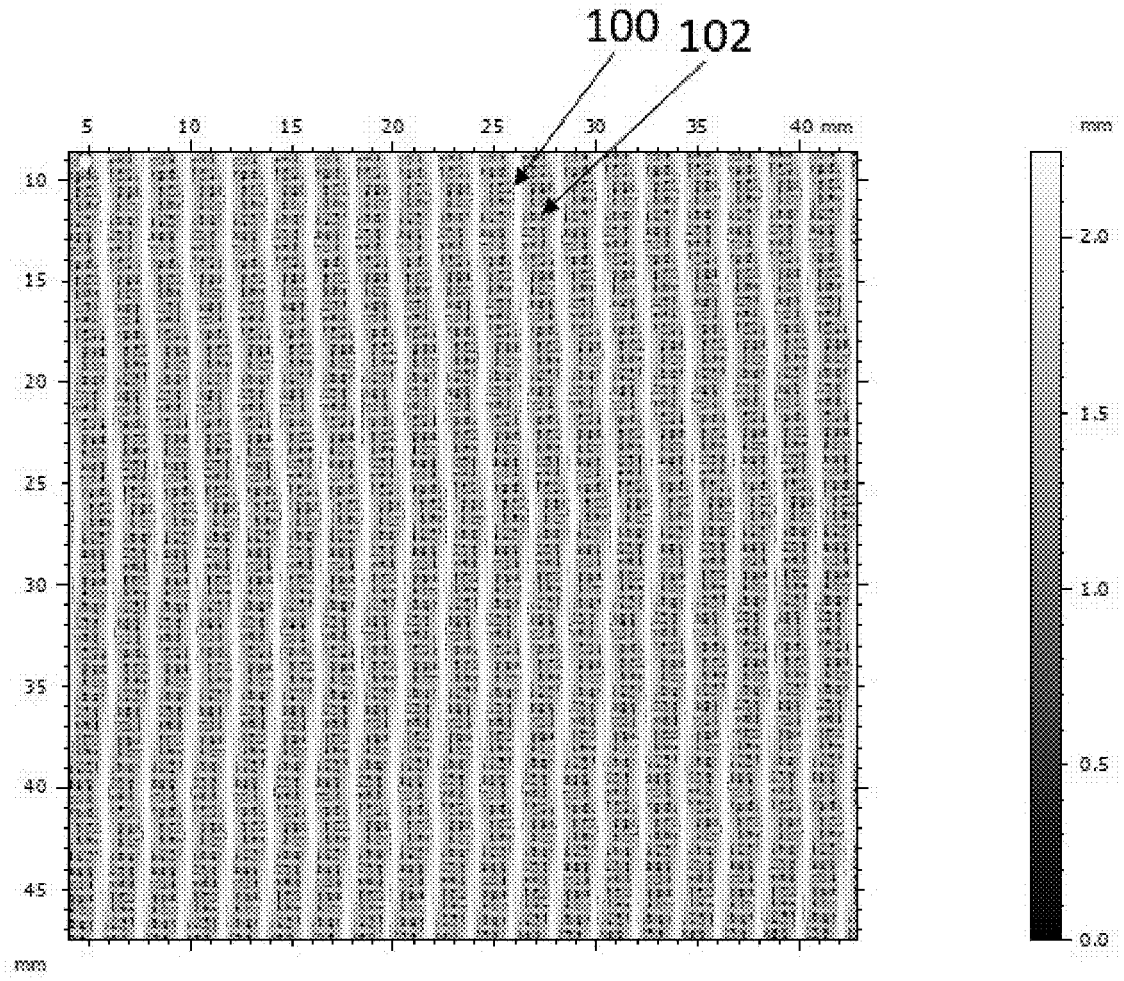
FIG. 4 is profilometry scan of a transfer fabric useful in the manufacture of tissue products according to the present invention.

A profilometry scan of one embodiment of a topographic transfer fabric useful in the present invention is shown in FIG. 4. The profilometry scan was obtained by scanning the fabric contacting surface of a fabric sample using an FRT MicroSpy® Profile profilometer (FRT of America, LLC, San Jose, Calif.) and then analyzing the image using Nanovea® Ultra software version 7.4 (Nanovea Inc., Irvine, Calif.). FIG. 4 illustrates the wave-like, substantially machine direction oriented, ridges 100 and valleys 102 disposed therebetween. The illustrated fabric was woven from warp and weft yarns having a similar diameter of about 0.30 mm. The yarns were woven to yield a fabric having valley depths, the vertical distance between the upper surface plane of the ridges and the bottom most surface plane of the web contacting surface of the fabric, of about 0.50 mm. Further, the yarns were woven to produce a plurality of substantially parallel, wave-like ridges spaced apart from one another a distance of about 2.0 mm.

Generally, transfer fabrics useful in the present invention have relatively deep valleys, such as valleys having valley depths greater than about 0.50 mm, such as from about 0.50 to about 0.70 mm. Valley depth may be measured by profilometry and is generally taken from a simulated base sheet generated by a morphological closing filter. The valley depth is measured as the difference between C2 (95 percentile height) and C1 (5 percentile height) values, having units of millimeters (mm). In certain instances, valley depth may be referred to as S90. To determine valley depth a profilometry scan of a fabric is generated and a histogram of the measured heights of the simulated base sheet is generated, and an S90 value (95 percentile height (C2) minus the 5 percentile height (C1), expressed in units of mm) is calculated.

The valley width of a given transfer fabric may vary depending on the weave pattern, however, in certain instances the valley width may be greater than about 1.5 mm and still more preferably greater than about 2.0 mm, such as from about 1.5 to about 3.5 mm. The valley width may also be measured by profilometry. Scans obtained as described above may be used to calculate the Psm value, having units of millimeters (mm).

Preferably the transfer fabrics of the present invention provide the nascent web with a relatively high degree of CD strain. Profilometry may again be used to determine the degree of CD strain imparted by the transfer fabric to the nascent web. Profilometry scans obtained as described above may be used to calculate the PLo value, which is indicative of CD strain, and is preferably at least about 15 percent, more preferably at least about 16 percent and still more preferably at least about 17 percent, such as from about 15 to about 19 percent.

With reference again to FIG. 3, the nascent web is transferred from the transfer fabric 40 to the through-air drying fabric 44 with the aid of a vacuum transfer roll 46 or a vacuum transfer shoe, optionally again using a fixed gap transfer as previously described. The through-air drying fabric can be traveling at about the same speed or a different speed relative to the transfer fabric. If desired, the through-air drying fabric can be run at a slower speed to further enhance stretch. Transfer can be carried out with vacuum assistance to ensure deformation of the sheet to conform to the through-air drying fabric, thus yielding desired bulk and imparting the web with a three-dimensional topographical pattern. Suitable through-air drying fabrics are described, for example, in U.S. Pat. Nos. 6,998,024, 7,611,607 and 10,161,084, the contents of which are incorporated herein by reference in a manner consistent with the present disclosure.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the through-air drying fabric, the web is dried to a consistency of about 94 percent or greater by the through-air dryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56.

In one embodiment, the reel 54 can run at a speed slower than the fabric 56 in a rush transfer process for building bulk into the paper web 52. For instance, the relative speed difference between the reel and the fabric can be from about 5 to about 25 percent and, particularly from about 12 to about 14 percent. Rush transfer at the reel can occur either alone or in conjunction with a rush transfer process upstream, such as between the forming fabric and the transfer fabric.

In certain embodiments basesheets useful in forming tissue products of the present invention may comprise a single homogenous or blended layer or be multi-layered. In those instances where the basesheet is multi-layered it may comprise, two, three, or more layers. For example, the basesheet may comprise three layers such as first and second outer layers and a middle layer disposed there between. The layers may comprise the same or different fiber types. For example, the first and second outer layers may comprise short, low coarseness wood pulp fibers, such as hardwood kraft pulp fibers, and the middle layer may comprise long, low coarseness wood pulp fibers, such as northern softwood kraft pulp fibers.

In those instances where the web comprises multiple layers, the relative weight percentage of each layer may vary. For example, the web may comprise first and second outer layers and a middle layer where the first outer layer comprises from about 25 to about 35 weight percent of the layered web, the middle layer comprises from about 30 to about 50 weight percent of the layered web and the second outer layer comprises from about 25 to about 35 weight percent of the layered web. Multi-layered basesheets useful in the present invention may be formed using any number of different processes known in the art, such as the process disclosed in U.S. Pat. No. 5,129,988, the contents of which are incorporated herein in a manner consistent with the present disclosure.

In certain embodiments, basesheets useful in forming tissue products of the present invention may be manufactured without a substantial amount of inner fiber-to-fiber bond strength. In this regard, the fiber furnish used to form the tissue web, or a given layer of the web, can be treated with a chemical debonding agent. The debonding agent can be added to the fiber slurry during the pulping process or can be added directly to the fiber slurry prior to the headbox. Suitable debonding agents that may be used in the present invention include cationic debonding agents, particularly quaternary ammonium compounds, mixtures of quaternary ammonium compounds with polyhydroxy compounds, and modified polysiloxanes.

Suitable cationic debonding agents include, for example, fatty dialkyl quaternary amine salts, mono fatty alkyl tertiary amine salts, primary amine salts, imidazoline quaternary salts and unsaturated fatty alkyl amine salts. Other suitable debonding agents are disclosed in U.S. Pat. No. 5,529,665, the contents of which are incorporated herein in a manner consistent with the present disclosure. In one embodiment, the debonding agent used in the process of the present invention is an organic quaternary ammonium chloride, such as those available under the tradename ProSoft™ (Solenis, Wilmington, Del.). The debonding agent can be added to the fiber slurry in an amount of from about 1.0 kg per metric tonne to about 15 kg per metric tonne of fibers present within the slurry.

Particularly useful quaternary ammonium debonders include imidazoline quaternary ammonium debonders, such as oleyl-imidazoline quaternaries, dialkyl dimethyl quaternary debonders, ester quaternary debonders, diamidoamine quaternary debonders, and the like. The imidazoline-based debonding agent can be added in an amount of between 1.0 to about 10 kg per metric tonne.

In other embodiments, a layer or other portion of the basesheet, including the entire basesheet, may optionally include wet or dry strength agents. As used herein, "wet strength agents" are materials used to immobilize the bonds between fibers in the wet state. Any material that when added to the tissue web at an effective level results in providing the basesheet with a wet geometric tensile strength:dry geometric tensile strength ratio in excess of 0.1 will, for purposes of this invention, be termed a wet strength agent. Particularly preferred wet strength agents are temporary wet strength agents. As used herein "temporary wet strength agents" are those which show less than 50 percent of their original wet strength after being saturated with water for five minutes.

Suitable temporary wet strength agents include materials that can react with hydroxyl groups, such as on cellulosic pulp fibers, to form hemiacetal bonds that are reversible in the presence of excess water. Suitable temporary wet strength agents are known to those of ordinary skill in the art. Non-limiting examples of temporary wet strength agents suitable for the fibrous structures of the present invention include glyoxalated polyacrylamide polymers, for example cationic glyoxalated polyacrylamide polymers. Temporary wet strength agents useful in the present invention may have average molecular weights of from about 20,000 to about 400,000, such as from about 50,000 to about 400,000, such as from about 70,000 to about 400,000, such as from about 70,000 to about 300,000, such as about 100,000 to about 200,000. In certain instances, the temporary wet strength agent may comprise a commercially available temporary wet strength agent such as those marketed under the tradename Hercobond™ (Solenis, Wilmington, Del.) or Fenno-Bond™ (Kemira, Atlanta, Ga.).

In other instances, the basesheet may optionally include a dry strength additive, such as carboxymethyl cellulose resins, starch based resins, and mixtures thereof. Particularly preferred dry strength additives are cationic starches, and mixtures of cationic and anionic starches. In certain instances, the dry strength agent may comprise a commercially available modified starch such as marketed under the tradename RediBOND™ (Ingredion, Westchester, Ill.) or a commercially available carboxymethyl cellulose resin such as those marketed under the tradename Aqualon™ (Ashland LLC, Bridgewater, N.J.).

The amount of wet strength agent or dry strength added to the pulp fibers can be at least about 0.1 dry weight percent, more specifically about 0.2 dry weight percent or greater, and still more specifically from about 0.1 to about 3 dry weight percent, based on the dry weight of the fibers.

After the tissue basesheet is manufactured, such as described above, it may be subjected to additional converting, such as calendering, treatment with a softening composition, embossing, slitting, winding and/or folding to produce the finished tissue products.

In certain embodiments tissue webs of the present invention may be treated with a softening composition to improve the hand feel or deliver a benefit to the end user. As used herein, the term "softening composition" refers to any chemical composition which improves the tactile sensation perceived by the end user who holds a particular tissue product and rubs it across the skin. Suitable softening compositions include, for example, basic waxes, such as paraffin and beeswax, and oils, such as mineral oil and silicone oil, as well as petrolatum and more complex lubricants and emollients, such as quaternary ammonium compounds with long alkyl chains, functional silicones, fatty acids, fatty alcohols and fatty esters.

Accordingly, in one embodiment the tissue webs of the present invention may be treated with a softening composition comprising one or more oils, such as mineral oil, waxes, such as paraffin, or plant extracts, such as chamomile and aloe vera, such as disclosed in U.S. Pat. Nos. 5,885,697 and 5,525,345, the contents of which are incorporated herein in a manner consistent with the present disclosure.

In other embodiments the tissue webs may be treated with a softening composition comprising a polysiloxane, and more preferably with a composition comprising an amino-functional polysiloxane, a surfactant and optionally a skin conditioning agent, such as the compositions disclosed in U.S. Publication No. 2006/0130989, the contents of which are incorporated herein in a manner consistent with the present disclosure. In certain preferred embodiments the polysiloxane is an amino-functional polysiloxane, the surfactant is an ethoxylated alcohol or an ethoxylated propoxylated alcohol, and the skin conditioning agent is vitamin E and/or aloe vera.

In still other embodiments the tissue webs may be treated with a softening composition comprising a cationic softening compound and a relatively high molecular weight polyhydroxy compound. Suitable cationic softening compounds include both quaternary ammonium compounds including, for example, amidoamine quaternary ammonium compounds, diamidoamine quaternary ammonium compounds, ester quaternary ammonium compounds, alkoxy alkyl quaternary ammonium compounds, benzyl quaternary ammonium compounds, alkyl quaternary ammonium compounds, and imidazolinium compounds. Examples of polyhydroxy compounds useful in the present invention include, but are not limited to, polyethylene glycols and polypropylene glycols having a molecular weight of at least about 1,000 g/mol and more preferably greater than about 2,000 g/mol and still more preferably greater than about 4,000 g/mol and more preferably greater than about 6,000 g/mol, such as from about 1,000 to about 12,000 g/mol, and more preferably from about 4,000 to about 10,000 g/mol and still more preferably from about 6,000 to about 8,000 g/mol.

In yet other embodiments the softening composition may comprise a cationic softening compound, a relatively high molecular weight polyhydroxy compound and polysiloxane. Any polysiloxane capable of enhancing the tactile softness of the tissue sheet is suitable for incorporation in this manner so long as solutions or emulsions of the cationic softener, polyhydroxy and silicone are compatible, that is when mixed they do not form gels, precipitates or other physical defects that would preclude application to the tissue sheet.

In other embodiments softening compositions useful in the present invention may consist essentially of water, a cationic softening compound, such as a quaternary ammonium compound, a polyhydroxy compound having a molecular weight of at least about 1,000 g/mol and optionally a silicone or glycerin, or mixtures thereof. In other embodiments the softening composition may consist essentially of water, a quaternary ammonium compound, a polyhydroxy compound having a molecular weight of at least about 1,000 g/mol, a silicone and glycerin. When incorporated in the softening composition, the amount of glycerin in the softening composition can be from about 5.0 to about 40 weight percent, more particularly from about 10 to about 30 weight percent, and still more particularly from about 15 to about weight percent.

All of the foregoing softening compositions may optionally contain a beneficial agent, such as a skin conditioning agent or a humectant, which may be provided in an amount ranging from about 0.01 to about 5 percent by weight of the composition. Suitable humectants include lactic acid and its salts, sugars, ethoxylated glycerin, ethoxylated lanolin, corn syrup, hydrolyzed starch hydrolysate, urea, and sorbitol. Suitable skin conditioning agents include allantoin, kaolin, zinc oxide, aloe vera, vitamin E, petrolatum and lanolin. Again, the foregoing additives are generally complementary to the softening compositions of the present invention and generally do not significantly and adversely affect important tissue product properties, such as strength or absorbency of the tissue product, or negatively affect the softening provided by the softening compositions of the present invention.

The foregoing softening compositions are generally applied to one or two outermost surfaces of a dry tissue web and more preferably a creped tissue web having a binding composition disposed on at least one outer surface. The method by which the softening composition is applied to the tissue sheet may be accomplished by any method known in the art. For example, in one embodiment the composition may be applied by contact printing methods such as gravure, offset gravure, flexographic printing, and the like. The contact printing methods often enable topical application of the composition to the tissue sheet. In other embodiments the softening composition may be applied to the tissue web by non-contact printing methods such as ink jet printing, digital printing of any kind, and the like.

In certain preferred embodiments the softening composition may be prepared as an aqueous solution and applied to the web by spraying or rotogravure printing. It is believed in this manner that tactile softness of the tissue sheet and resulting tissue products may be improved due to presence of the softening composition on the surface of the tissue product. When applied as an aqueous solution, the softening composition may comprise from about 50 to about 90 weight percent, by weight of the composition, water and more preferably from about 60 to about 80 percent.

Test Methods

Profilometry

Fabric properties are generally measured using a non-contact profilometer as described herein. To prevent any debris from affecting the measurements, all images are subjected to thresholding to remove the top and bottom 0.5 mm of the scan. To fill any holes resulting from the thresholding step and provide a continuous surface on which to perform measurements, non-measured points are filled. The image is also flattened by applying a rightness filter. Finally, a base sheet simulation is obtained using morphological filtering.

Profilometry scans of the fabric contacting surface of a sample were created using an FRT MicroSpy® Profile profilometer (FRT of America, LLC, San Jose, Calif.) and then analyzing the image using Nanovea® Ultra software version 7.4 (Nanovea Inc., Irvine, Calif.). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimensional height map of the sample surface. A 1602×1602 array of height values were obtained with a 30 μm spacing resulting in a 48 mm MD×48 mm CD field of view having a vertical resolution 100 nm and a lateral resolution 6 μm. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height;

(2) Using the "Fill in Non-Measured Points" function of the Nanovea® Ultra software the non-measured points are filled by a smooth shape calculated from neighboring points;

(3) Using Robust Gaussian filter roughness filter with a cut off wavelength of 24.0 mm and selecting "manage end effects";

(4) Using the "Morphilogical Filtering" selecting "closing filter and a structuring element of a sphere with a 1.7 mm diameter";

(5) Using the "Abbott-Firestone Curve" study function of the Nanovea® Ultra software an Abbott-Firestone Curve is generated from which "interactive mode" is selected and a histogram of the measured heights is generated, from the histogram an S90 value (95 percentile height (C2) minus the 5 percentile height (C1), expressed in units of mm) is calculated.

(6) Using "convert surface into series of profiles" and data from "parameters table".

Based upon the foregoing, three values, indicative of the fabric topography are reported—valley depth, valley width and strain. Valley width is the Psm value having units of millimeters (mm). Valley depth is the difference between C2 and C1 values and has units of millimeters (mm). In certain instances, pocket depth may be referred to as S90. Strain is the PLo value having units of percent (%).

Basis Weight

Prior to testing, all samples are conditioned under TAPPI conditions (23±1° C. and 50±2 percent relative humidity) for a minimum of 4 hours. Basis weight of sample is measured by selecting twelve (12) products (also referred to as sheets) of the sample and making two (2) stacks of six (6) sheets. In the event the sample consists of perforated sheets of bath or towel tissue, the perforations must be aligned on the same side when stacking the usable units. A precision cutter is used to cut each stack into exactly 10.16×10.16 cm (4.0×4.0 inch) squares. The two stacks of cut squares are combined to make a basis weight pad of twelve (12) squares thick. The basis weight pad is then weighed on a top loading balance with a minimum resolution of 0.01 grams. The top loading balance must be protected from air drafts and other disturbances using a draft shield. Weights are recorded when the readings on the top loading balance become constant. The mass of the sample (grams) per unit area (square meters) is calculated and reported as the basis weight, having units of grams per square meter (gsm).

Caliper

Caliper is measured in accordance with TAPPI Test Method T 580 pm-12 "Thickness (caliper) of towel, tissue, napkin and facial products." The micrometer used for carrying out caliper measurements is an Emveco 200-A Tissue Caliper Tester (Emveco, Inc., Newberg, Oreg.). The micrometer has a load of 2 kilo-Pascals, a pressure foot area of 2,500 square millimeters, a pressure foot diameter of 56.42 millimeters, a dwell time of 3 seconds and a lowering rate of 0.8 millimeters per second.

Tensile

Tensile testing is conducted on a tensile testing machine maintaining a constant rate of elongation and the width of each specimen tested is 3 inches. Testing is conducted under TAPPI conditions. More specifically, samples for dry tensile strength testing were prepared by conditioning under TAPPI conditions for at least 4 hours and then cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full-scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength having units of grams per three inches (g/3"). Tensile energy absorbed (TEA) and slope are also calculated by the tensile tester. TEA is reported in units of g·cm/cm$^2$ and slope is recorded in units of kilograms (kg). Both TEA and Slope are directionally dependent and thus MD and CD directions are measured independently.

All products were tested in their product forms without separating into individual plies. For example, a 2-ply product was tested as two plies and recorded as such. In the tensile properties of basesheets were measured, the number of plies used varied depending on the intended end use. For example, if the basesheet was intended to be used for 2-ply product, two plies of basesheet were combined and tested.

Example

Basesheets were made using a through-air dried papermaking process commonly referred to as "uncreped through-air dried" ("UCTAD") and generally described in U.S. Pat. No. 5,607,551, the contents of which are incorporated herein in a manner consistent with the present disclosure. The basesheets were then converted by calendering, slitting and winding to yield single ply tissue products.

Basesheets were prepared using a three-layered headbox to form a web having a first outer layer, also referred to as the fabric or fabric contacting layer, a middle layer, and a second outer layer, also referred to as the air contacting or air layer. The furnish split, which consisted of eucalyptus hardwood kraft pulp (EHWK) and northern softwood kraft pulp (NSWK), and treatment of the various furnish layers is detailed in Table 2, below. In those instances where debonder (ProSoft™ TQ-1003, Solenis. Wilmington, Del.) was added, it was selectively added to the middle layer. Further, strength was controlled via the addition of starch and/or by refining the furnish.

TABLE 2

| Sample | Fabric Layer Furnish (wt %) | Middle Layer Furnish (wt %) | Air Layer Furnish (wt %) | Debonder (kg/MT) | Dry Strength (kg/MT) |
|---|---|---|---|---|---|
| Control Basesheet | 32.5 | 35 | 32.5 | 2.5 | 6 |
| Inventive Basesheet | 32.5 | 35 | 32.5 | 2.5 | 10 |

Each furnish was diluted to approximately 0.2 percent consistency and delivered to a layered headbox and deposited on a Voith Fabrics TissueForm V forming fabric (commercially available from Voith Fabrics, Appleton, Wis.). The wet web was vacuum dewatered to approximately 25 percent consistency and then transferred to a transfer fabric. Inventive samples were transferred to the fabric depicted in FIG. 4 and described further in Table 3, below. The transfer fabric used to produce the control samples is also described in Table 3, below. Both transfer fabrics are commercially available from Voith Fabrics, Appleton, Wis.

TABLE 3

| | S90 (mm) | Psm (mm) | PLo (%) | Air Permeability (CFM) | Fabric Caliper (mm) | MD Oriented Ridges per 48 mm |
|---|---|---|---|---|---|---|
| Inventive | 0.56 | 2.03 | 18.0 | 360 | 1.46 | 24 |
| Control | 0.66 | 2.66 | 15.8 | 479 | 1.71 | 18 |

The web was transferred from the transfer fabric to a through-air drying fabric substantially as described in co-pending U.S. patent application Ser. No. 16/205,355, the contents of which are incorporated herein in a manner consistent with the present disclosure. The through-air drying fabric consisted of a woven base fabric (t1205-2 woven fabric, commercially available from Voith Fabrics, Appleton, Wis. and previously described in U.S. Pat. No. 8,500,955). The woven base fabric had a plurality of spaced apart substantially continuous machine direction (MD) oriented protuberances that defined a plurality of valleys there between. The fabric further comprised a plurality of discrete, non-woven, cross-machine direction (CD) oriented protuberances. The discrete, non-woven, cross-machine direction (CD) oriented protuberances comprised a silicone printed onto the base fabric and covered approximately 7.5 percent of the web contacting surface of the fabric.

The nascent web was rush transferred to the through-air drying fabric at a rush transfer rate of 28 percent. The web was through-air dried while supported by the through-air drying fabric to yield a basesheet having a geometric mean tensile (GMT) of about 1,100 g/3", a basis weight of about 40 gsm. The basesheet was subjected to various calender loads, slit and wound into single ply rolled tissue products. The products were subject to physical testing as summarized in Tables 4 and 5, below.

TABLE 4

| Sample | Basis Weight (gsm) | Caliper (μm) | Sheet Bulk (cc/g) | GMT (g/3") | GM Slope (kg) | GM Stretch (%) | Stiffness Index |
|---|---|---|---|---|---|---|---|
| Control | 35.84 | 674 | 18.8 | 760 | 4.98 | 12.9 | 5.00 |
| Inventive 1 | 35.42 | 709 | 20.0 | 905 | 4.59 | 17.0 | 4.12 |
| Inventive 2 | 35.44 | 569 | 16.1 | 807 | 4.27 | 16.5 | 4.22 |
| Inventive 3 | 35.44 | 445 | 12.6 | 766 | 3.92 | 16.6 | 4.03 |
| Inventive 4 | 35.43 | 438 | 12.4 | 770 | 4.00 | 16.1 | 4.04 |
| Inventive 5 | 35.44 | 377 | 10.6 | 744 | 3.98 | 15.8 | 4.15 |

TABLE 5

| Sample | CD Tensile (g/3") | CD TEA (g · cm/cm$^2$) | CD Stretch (%) | CD Slope (kg) | CD TEA Index |
|---|---|---|---|---|---|
| Control | 580 | 5.75 | 11.4 | 3.68 | 9.9 |
| Inventive 1 | 735 | 7.55 | 14.7 | 3.27 | 10.3 |
| Inventive 2 | 645 | 6.86 | 14.6 | 3.01 | 10.6 |
| Inventive 3 | 604 | 6.57 | 15.8 | 2.52 | 10.9 |
| Inventive 4 | 599 | 6.56 | 15.6 | 2.41 | 11.0 |
| Inventive 5 | 577 | 6.47 | 16.0 | 2.29 | 11.2 |

EMBODIMENTS

First Embodiment

A rolled tissue product comprising a single ply tissue web spirally wound about a core, the web having a cross-machine direction (CD) tensile greater than about 550 g/3" and a CD Stretch greater than about 14.0 percent.

Second Embodiment

The product of the first embodiment wherein the single-ply tissue web having a GMT from about 700 to about 1,000 g/3" and a geometric mean stretch (GM Stretch) of about percent or greater, such as from about 15 to about 17 percent.

Third Embodiment

The product of embodiments 1 or 2 wherein the single-ply tissue web has a CD TEA of about 6.0 g·cm/cm$^2$ or greater.

Fourth Embodiment

The product of any one of embodiments 1 through 3 wherein the single-ply tissue web has a GM TEA greater than about 10 g·cm/cm$^2$.

Fifth Embodiment

The product of any one of embodiments 1 through 4 wherein the single-ply tissue web has a Stiffness Index less than about 5.0.

Sixth Embodiment

The product of any one of embodiments 1 through 5 wherein the single-ply tissue web has a CD Stretch from about 14.0 to about 17.0 percent.

Seventh Embodiment

The product of any one of embodiments 1 through 6 wherein the single-ply tissue web has a CD Tensile from about 550 to about 750 g/3".

Eighth Embodiment

The product of any one of embodiments 1 through 7 wherein the single-ply tissue web has a basis weight from about 32 to about 40 grams per square meter (gsm) and a sheet bulk greater than about 10.0 cubic centimeters per gram (cc/g).

Ninth Embodiment

The product of any one of embodiments 1 through 8 wherein the single-ply tissue web has a basis weight from about 34 to about 38 grams per square meter (gsm) and a sheet bulk from about 14.0 to about 20.0 cc/g.

Tenth Embodiment

The product of any one of embodiments 1 through 9 wherein the single-ply tissue web has a GM Slope from about 3.5 to about 5.0 and TEA Index from about 10.0 to about 13.0.

Eleventh Embodiment

The product of any one of embodiments 1 through 10 wherein the web is through-air dried.

Twelfth Embodiment

The product of any one of embodiments 1 through 11 wherein the web is uncreped.

What is claimed is:

1. A rolled tissue product comprising a single ply tissue web spirally wound about a core, the single ply web having a basis weight from 32 to 40 gsm, a Stiffness Index of about 5.0 or less, a cross-machine direction (CD) tensile greater than about 550 g/3" and a CD Stretch greater than about 14.0 percent.

2. The rolled tissue product of claim 1 wherein the single ply web has a GMT from about 700 to about 1,000 g/3" and a geometric mean stretch (GM Stretch) of about 15 percent or greater.

3. The rolled tissue product of claim 1 wherein the single ply web has a CD TEA of about 6.0 g·cm/cm$^2$ or greater.

4. The rolled tissue product of claim 1 wherein the single ply web has a GM TEA of about 10 g·cm/cm$^2$ or greater.

5. The rolled tissue product of claim 1 wherein the single ply web has a Stiffness Index from 3.5 to 5.0.

6. The rolled tissue product of claim 1 wherein the single ply web has a CD Tensile from about 550 to about 750 g/3" and a CD Stretch from about 14.0 to about 17.0 percent.

7. The rolled tissue product of claim 1 wherein the single ply web has a sheet bulk of about 10.0 cubic centimeters per gram (cc/g) or greater.

8. The rolled tissue product of claim 1 wherein the single ply web is uncreped.

9. The rolled tissue product of claim 1 wherein the single ply web is through-air dried and uncreped.

10. A rolled tissue product comprising a spirally wound uncreped and through-air dried single ply tissue web having a basis weight from 32 to 40 gsm, a Stiffness Index of about 5.0 or less, a GMT from 700 to 1,000 g/3" and a CD Stretch of about 14.0 percent or greater.

11. The product of claim 10 wherein the web has a CD Tensile from about 550 to about 750 g/3" and a CD Stretch from about 14.0 to about 17.0 percent.

12. The product of claim 10 wherein the web has a CD TEA of about 6.0 g·cm/cm$^2$ or greater.

13. The product of claim 10 wherein the web has a GM TEA greater than about 10 g·cm/cm$^2$.

14. The product of claim 10 wherein the web Stiffness Index from 3.5 to 5.0.

15. The product of claim 10 wherein the web has a CD Tensile from about 575 to about 650 g/3" and a CD Stretch from about 14.0 to about 17.0 percent.

16. The product of claim 15 wherein the web has a CD TEA from about 6.0 to about 8.0 g·cm/cm$^2$.

17. The product of claim 16 wherein the web has a CD Slope less than about 3.0 kg.

* * * * *